US008328567B1

(12) United States Patent
Yang

(10) Patent No.: US 8,328,567 B1
(45) Date of Patent: Dec. 11, 2012

(54) CARD EDGE CONNECTOR AND ASSEMBLY INCLUDING THE SAME

(75) Inventor: Yong Teck Yang, Singapore (SG)

(73) Assignee: Molex Incorporated, Lisle, IL (US)

( * ) Notice: Subject to any disclaimer, the term of this patent is extended or adjusted under 35 U.S.C. 154(b) by 35 days.

(21) Appl. No.: 13/105,517

(22) Filed: May 11, 2011

(30) Foreign Application Priority Data

May 11, 2010 (SG) ..... 201003295-1

(51) Int. Cl.
*H01R 13/62* (2006.01)

(52) U.S. Cl. ..... 439/157

(58) Field of Classification Search ..... 439/157, 439/159–160, 327–328
See application file for complete search history.

(56) References Cited

U.S. PATENT DOCUMENTS

| | | | | |
|---|---|---|---|---|
| 7,500,863 | B2 * | 3/2009 | Ringler et al. | 439/327 |
| 7,637,748 | B2 * | 12/2009 | Chung et al. | 439/59 |
| 7,661,974 | B1 * | 2/2010 | Sun | 439/328 |
| 7,677,907 | B2 * | 3/2010 | Guan et al. | 439/157 |
| 7,828,566 | B2 * | 11/2010 | Chen et al. | 439/157 |
| 7,857,628 | B2 * | 12/2010 | Chung et al. | 439/59 |
| 7,922,506 | B1 * | 4/2011 | Harlan et al. | 439/160 |

* cited by examiner

*Primary Examiner* — Jean F Duverne
(74) *Attorney, Agent, or Firm* — Stephen L. Sheldon

(57) ABSTRACT

A card edge connector includes a dielectric housing having an end portion configured to receive a latch/eject member for ejecting and latching a card module in a pivot manner. The latch/eject member includes a lower end surface, which is located outside the dielectric housing when the latch/eject member is in the locking position.

11 Claims, 16 Drawing Sheets

CARD EDGE CONNECTOR AND ASSEMBLY INCLUDING THE SAME

RELATED APPLICATIONS

This application claims priority to Singapore Patent Application No. 201003295-1, filed May 11, 2010, which is incorporated herein by reference in its entirety.

FIELD OF THE INVENTION

The present invention relates to a card edge connector, and more particularly, to a card edge connector configured to receive a vertically inserted card module.

DESCRIPTION OF THE RELATED ART

Card edge connectors configured to receive vertically inserted card modules are commonly used in electronic devices. As demand for compact electronic devices rises in the modern electronics industry, the height of vertically inserted card modules is expected to be reduced.

Referring to FIGS. 1 to 3, a card edge connector 1 includes a housing 11 having a slot 111 for receiving a card module 2, a plurality of terminals 12 arrayed along the slot 111, and a pair of latch-and-eject levers 13 separately disposed on two opposite ends of the housing 11. The card edge connector 1 is mounted on a printed circuit board 3 with the slot 111 facing upward. The latch-and-eject lever 13 includes an ejector 131 located adjacent to the bottom of the housing 11 and configured to engage the inserted edge of the card module 2.

An inserted card module 2 can be ejected from the card edge connector 1 by rotating the latch-and-eject lever 13. A force is applied on the top 132 of the latch-and-eject lever 13 to rotate the latch-and-eject lever 13, moving the ejector 131 to push the inserted edge of the card module 2 until the card module 2 is released from the card edge connector 1. Generally, the latch-and-eject lever 13 is made of plastics, and to sustain the stress induced by card ejection operation, the ejector 131 must have sufficient thickness. To accommodate the thick ejector 131, a sufficient space between the inserted edge of the card module 2 and the printed circuit board 3 must be reserved. However, such a necessary space prevents the possibility of the reduction of the height of the card module 2.

In addition, the housing 11 includes a seating base 112 located below the slot 111 for supporting the card module 2. The seating base 112 defines a module-seating plane. After the card module 2 is inserted, the edge of the card module 2 rests on the seating base 112. Similarly, the seating base 112 separates the card module 2 from the printed circuit board 3, and the height of the seating base 112 increases the total height of an inserted card module 2.

In summary, a conventional card edge connector with a pair of latch-and-eject levers configured to receive a vertically inserted card module needs a space to accommodate the ejector of the latch-and-eject lever and the seating base of its housing for supporting a card module. It is not easy to reduce height of the card edge connector. Therefore, an improved card edge connector would appreciated by certain individuals.

SUMMARY OF THE INVENTION

In an example, a card edge connector includes a dielectric housing having an end portion configured to receive a latch/eject member for ejecting and latching a card module in a pivot manner. The latch/eject member includes a lower end surface, wherein the card edge connector has a low module-seating plane so that the lower end surface of the latch/eject member can be located outside the dielectric housing when the latch/eject member is in the locking position. The dielectric housing includes a card-receiving slot, which can be a through slot or disposed above a thin base. The card edge connector may further include a projection member disposed on a side wall flanking the card-receiving slot to reinforce the side wall.

If desired a connector assembly can include a circuit board, such as a printed circuit board, and the above-mentioned card edge connector disposed on the circuit board. The circuit board includes a hole disposed with respect to the latch/eject member, wherein the lower end surface of the latch/eject member can be located in the hole when the latch/eject member is in the locking position.

BRIEF DESCRIPTION OF THE DRAWINGS

The invention will be described according to the appended drawings in which.

DETAILED DESCRIPTION

Figure 1:
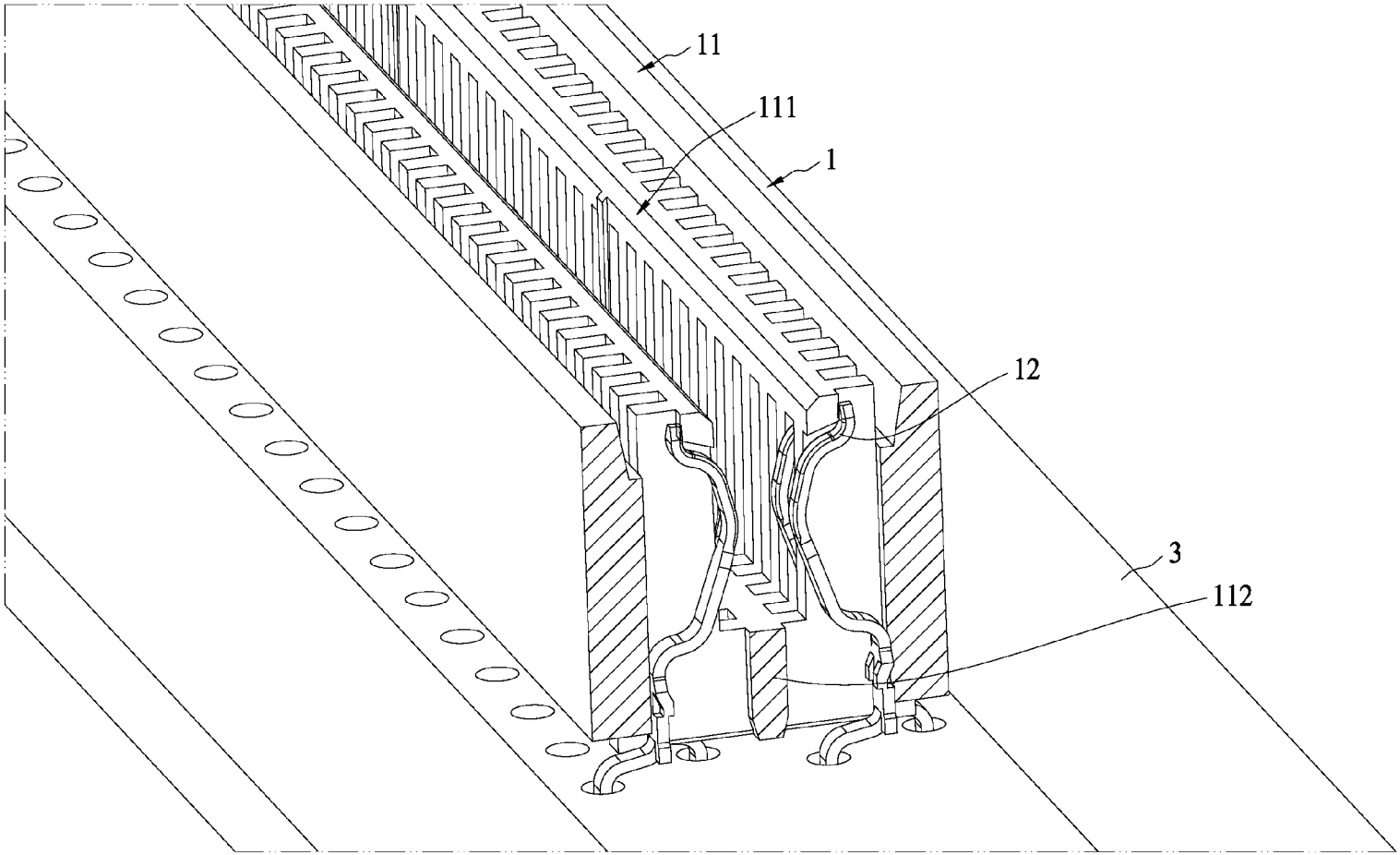
FIG. 1 illustrates a conventional card edge connector having a high seating base.
Figure 2:
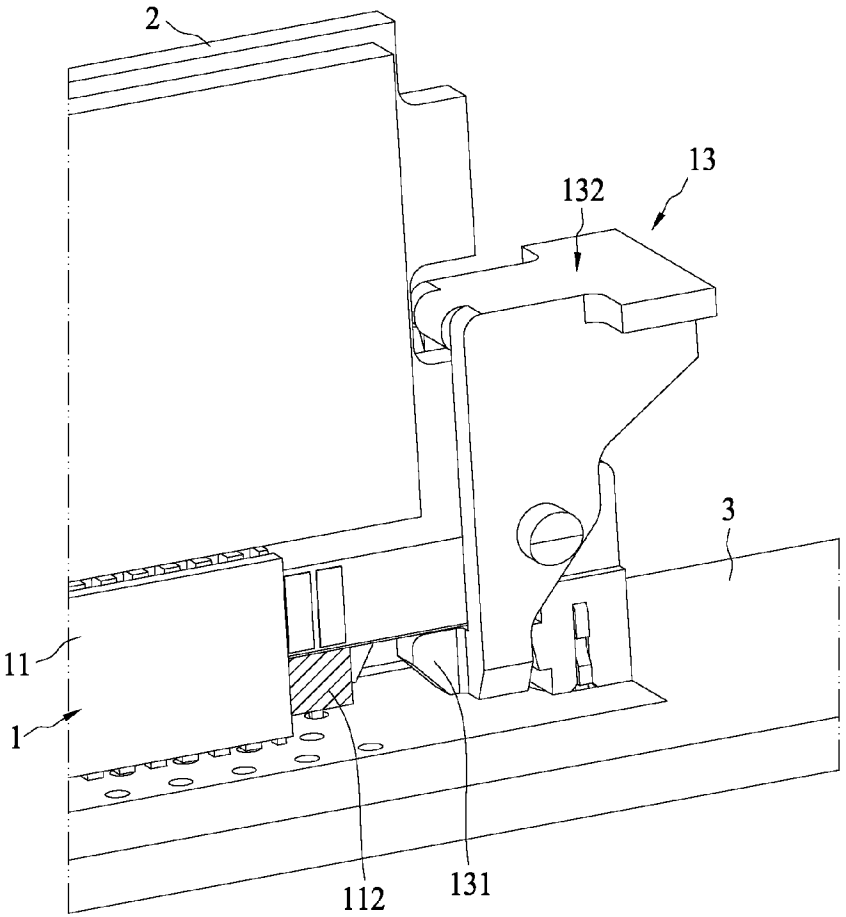
FIG. 2 illustrates a conventional card edge connector including a latch-and-eject lever having a thick ejector disposed within the card edge connector.
Figure 3:
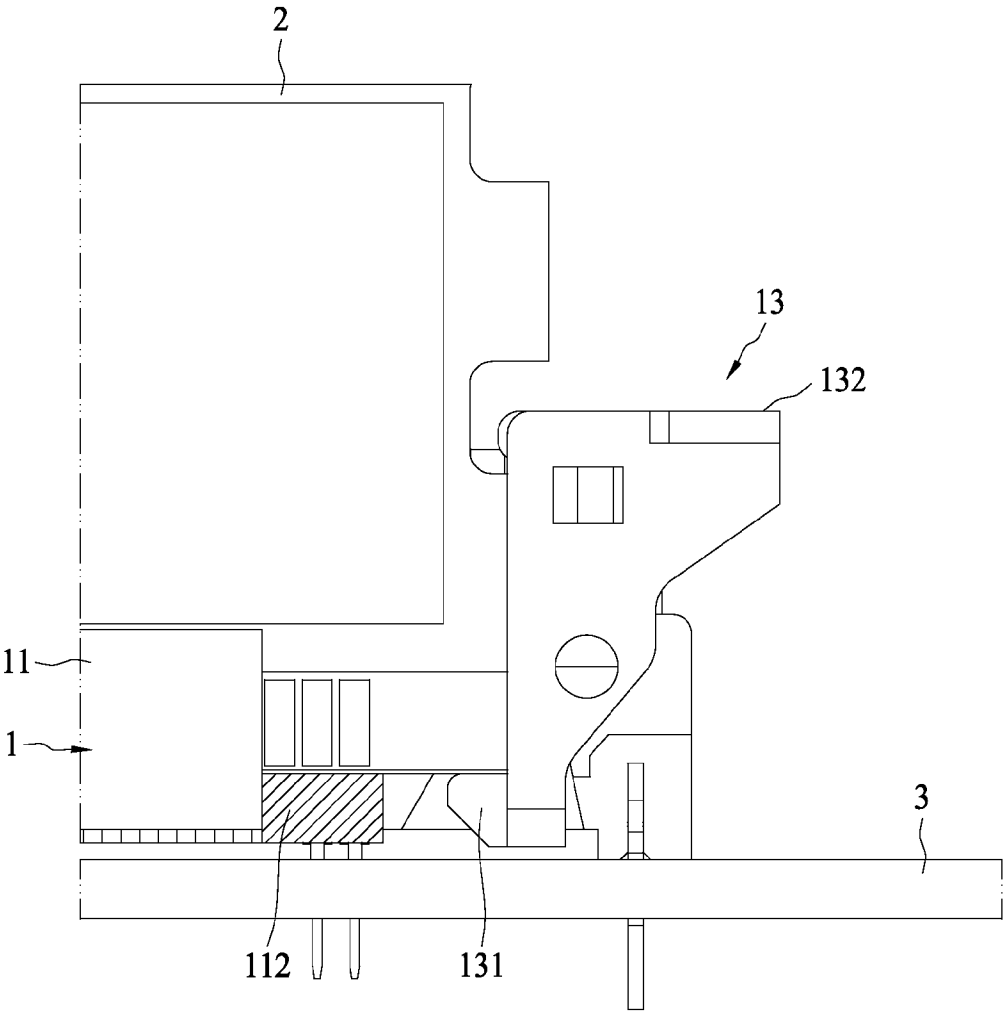
FIG. 3 is a front view of FIG. 2.
Figure 4:
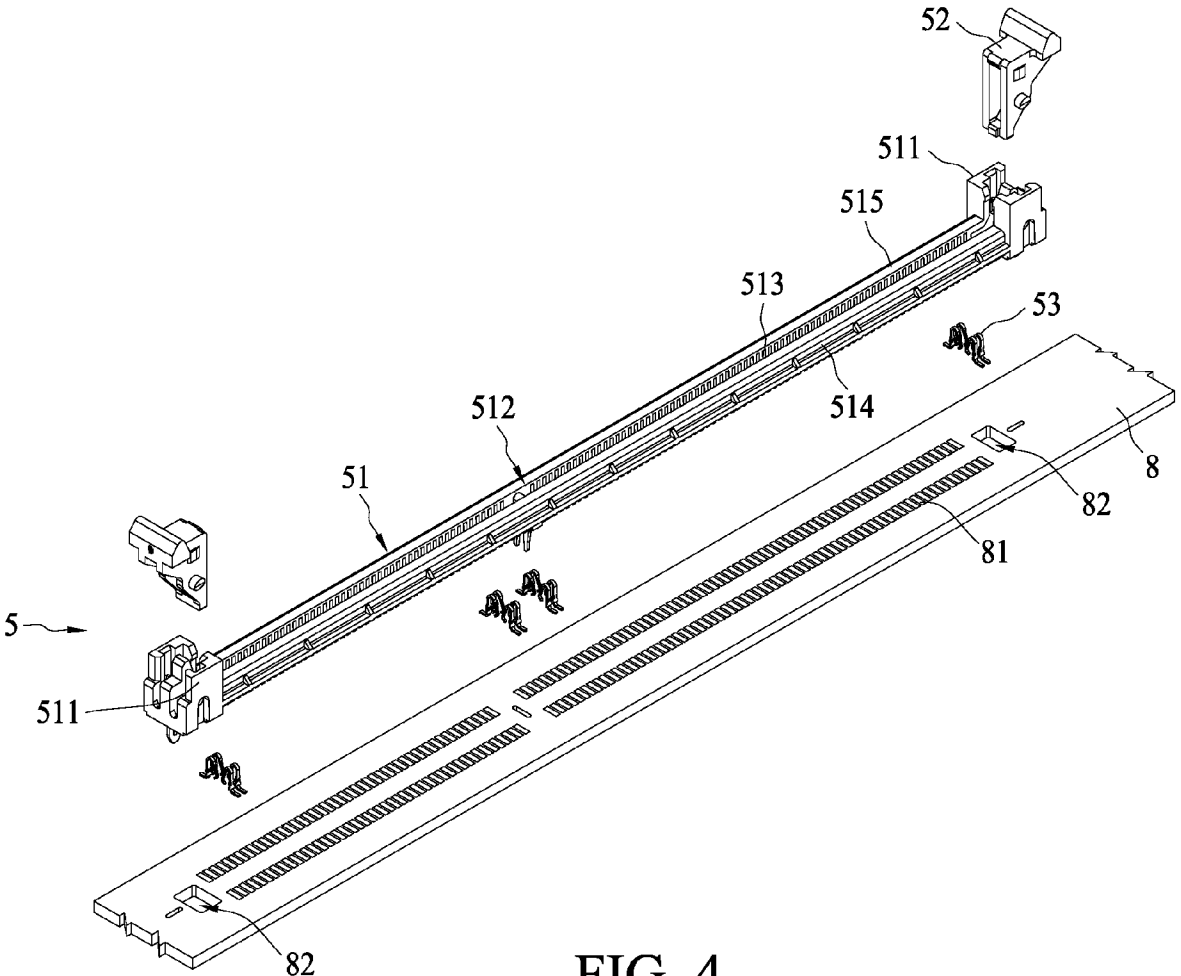
FIG. 4 is a perspective exploded view showing an embodiment of a circuit board and a card edge connector.

As shown in FIG. 4, one embodiment provides a card edge connector 5, which comprises a dielectric housing 51, at least one latch/eject member 52 for ejecting and latching a card module, and a plurality of terminals 53 for electrically connecting the card module to a circuit board, such as a conventional printed circuit board.

Figure 5:
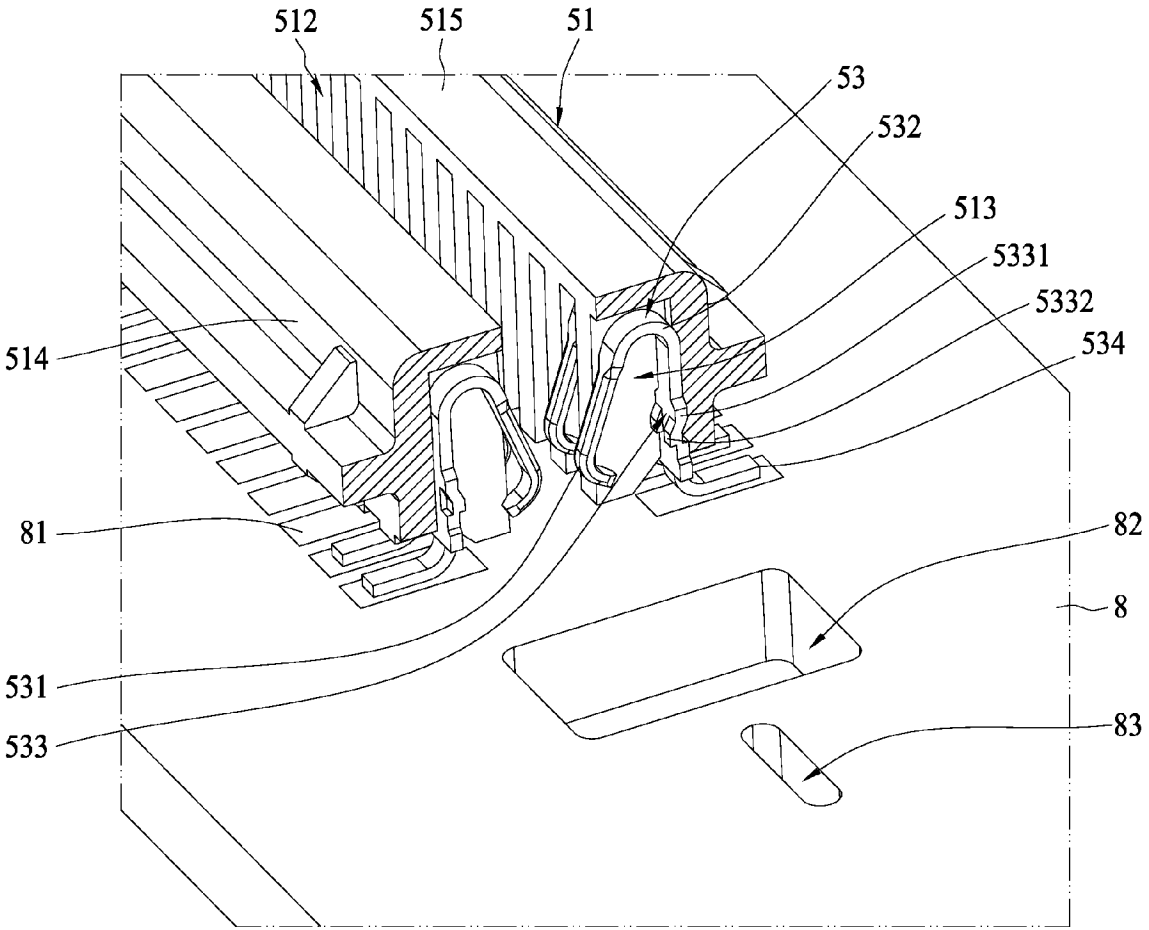
FIG. 5 is a fragmentary sectional view showing an embodiment of a card edge connector mounted on a circuit board.
Figure 10:
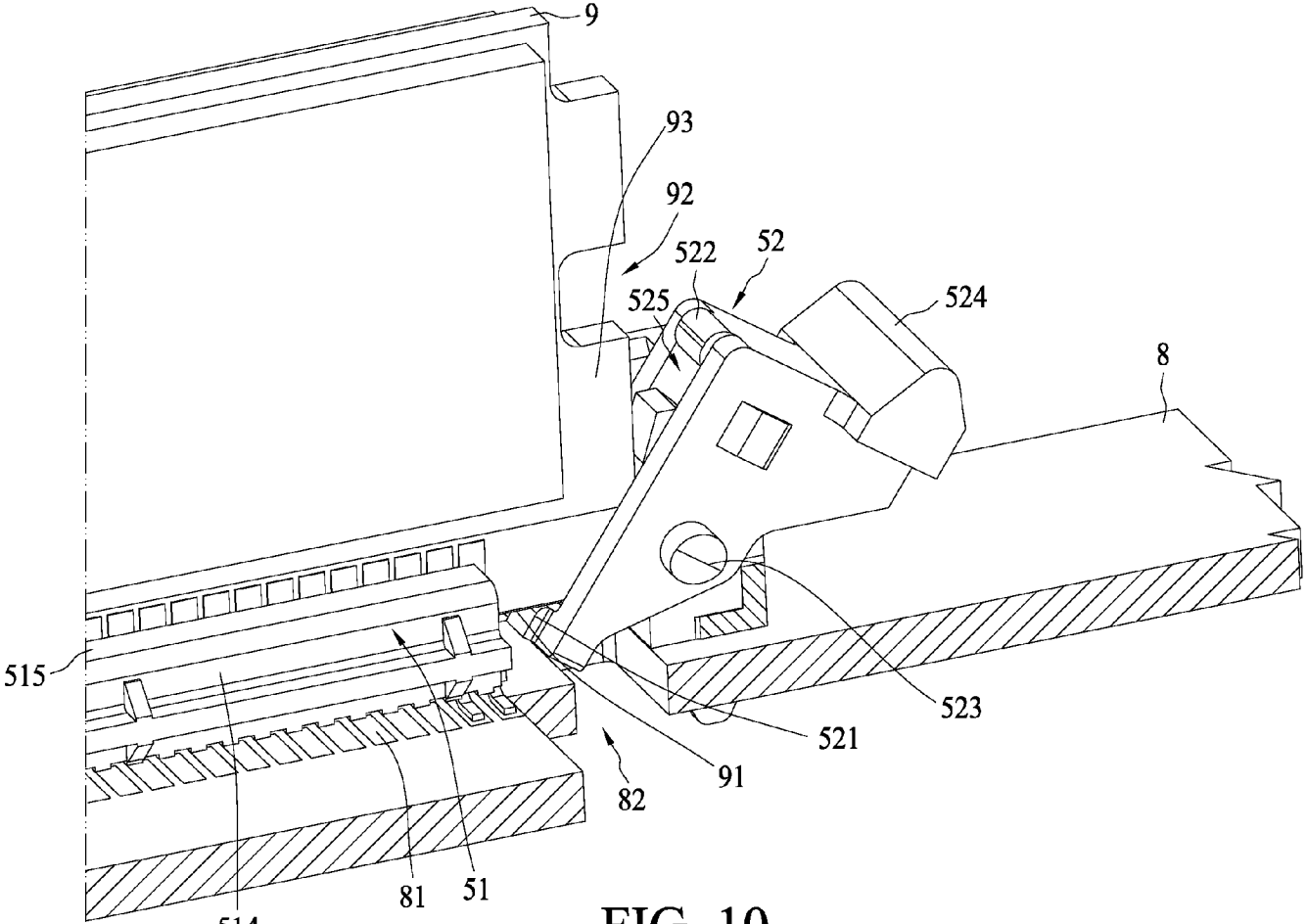
FIG. 10 a fragmentary section view showing an embodiment of a latch/eject member in an unlocking position.
Figure 11:
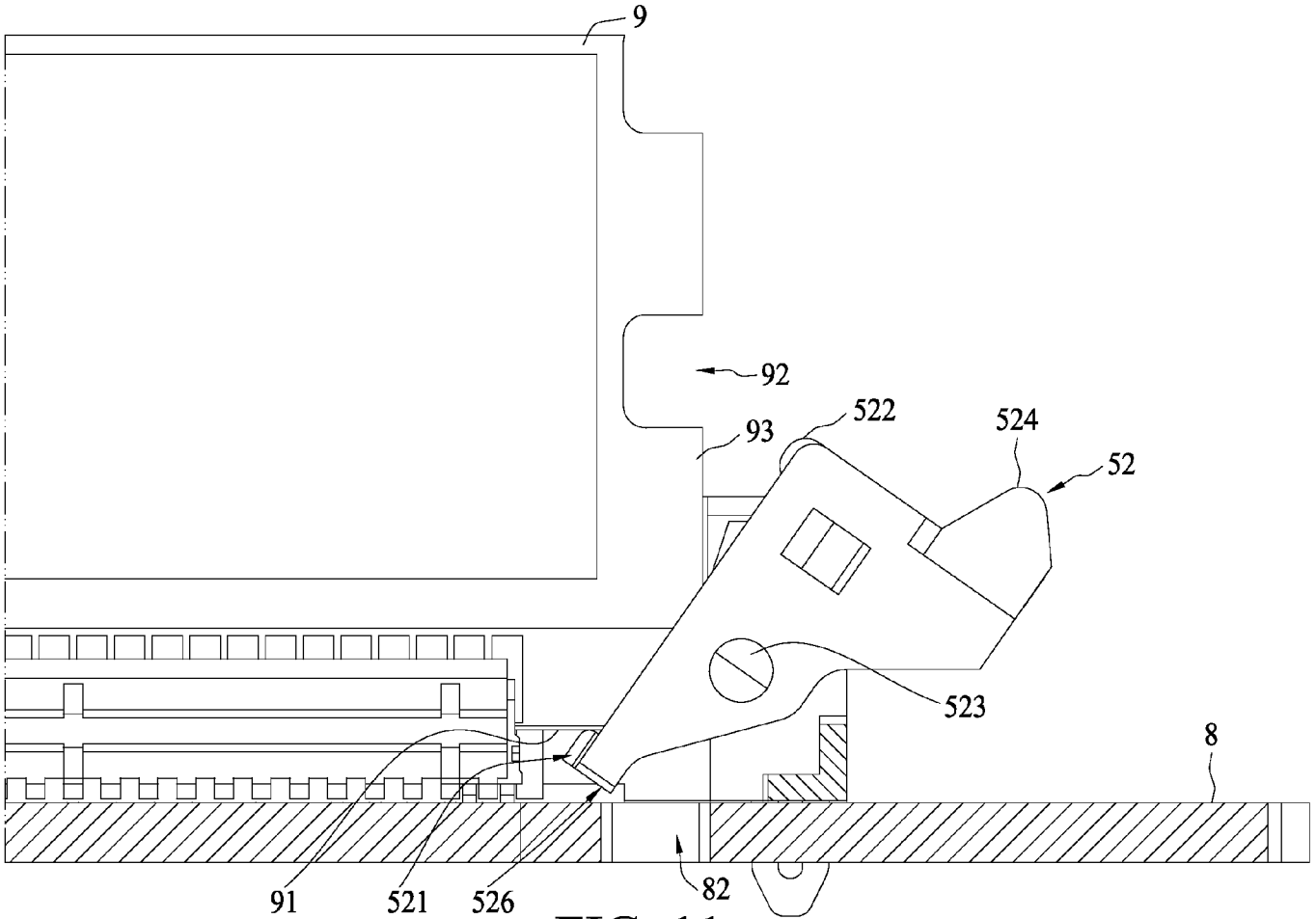
FIG. 11 is a front view of FIG. 10.

Further referring to FIGS. 4, 5, and 10, the dielectric housing 51 may include two end portions 511, a card-receiving slot 512 extending between the two end portions 511, and a plurality of cavities 513. The dielectric housing 51 includes an elongated portion extending between the two end portions 511 and defined by two parallel side walls 514 and a top wall 515, on which the card-receiving slot 512 is formed for receiving a vertically inserted card module 9 as shown in FIG. 10. The plurality of cavities 513 are arrayed along and on two opposite sides of the card-receiving slot 512 and configured to respectively receive the plurality of terminals 53.

Referring to FIG. 5, the card edge connector 5 is configured to be mounted on a circuit board 8 including an electrical circuit with some traces for electrical contact with the plurality of terminals 53. Each terminal 53 may include a contact portion 531, a fixing portion 533, and a solder tail 534. The contact portion 531 and the solder tail 534 are separately disposed on opposite sides of the fixing portion 533. The fixing portion 533 is configured to secure the terminal 53 in the respective cavity 513. The solder tails 534 can be configured to electrically engage the respective traces of the electrical circuit using a pin-through technology or a surface mount technology. Further referring to FIG. 6, in the present embodiment, the solder tail 534 is configured to extend adjacent to the bottom 516 of the dielectric housing 51 and parallel to the surface of the circuit board 8, and is surface mounted to the respective solder pad 81 on the circuit board 8.

Referring to FIGS. 6, 7, and 10 to 13, the card edge connector 5 may comprise at least one latch/eject member 52, and one of the two end portions 511 is configured to receive the at least one latch/eject member 52 and to allow the latch/eject member 52 to move in a pivoting manner in the end portion 511. The latch/eject member 52 may include an ejecting portion 521, a latching portion 522, and a pair of pivot pins 523. The ejecting portion 521, the latching portion 522, and the pair of pivot pins 523 can be arranged such that either the ejecting portion 521 or the latching portion 522 moves toward the card-receiving slot 512 when the latch/eject member 52 is rotated.

Figure 12:
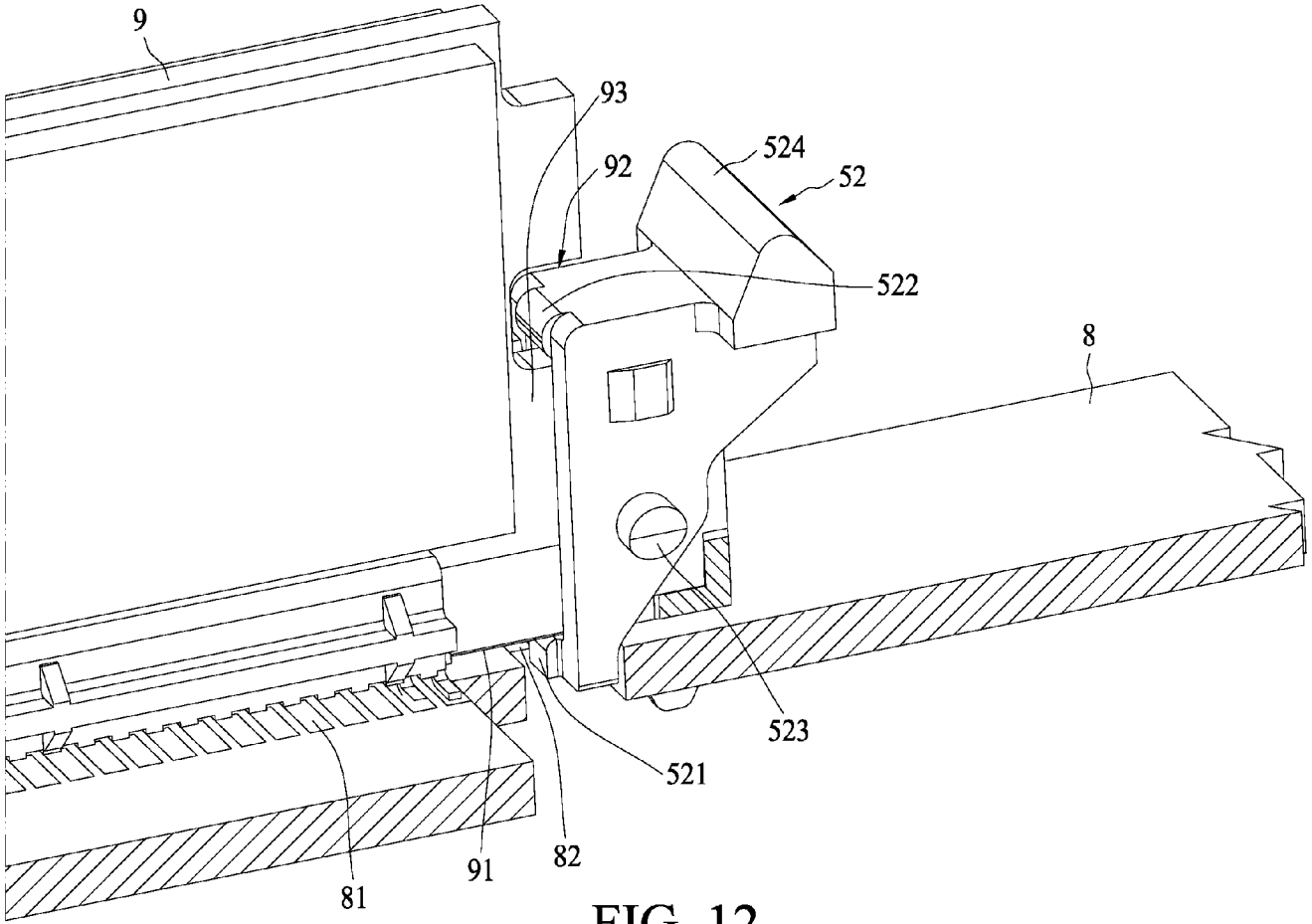
FIG. 12 is a fragmentary section view showing an embodiment of a latch/eject member locking a card module.
Figure 13:
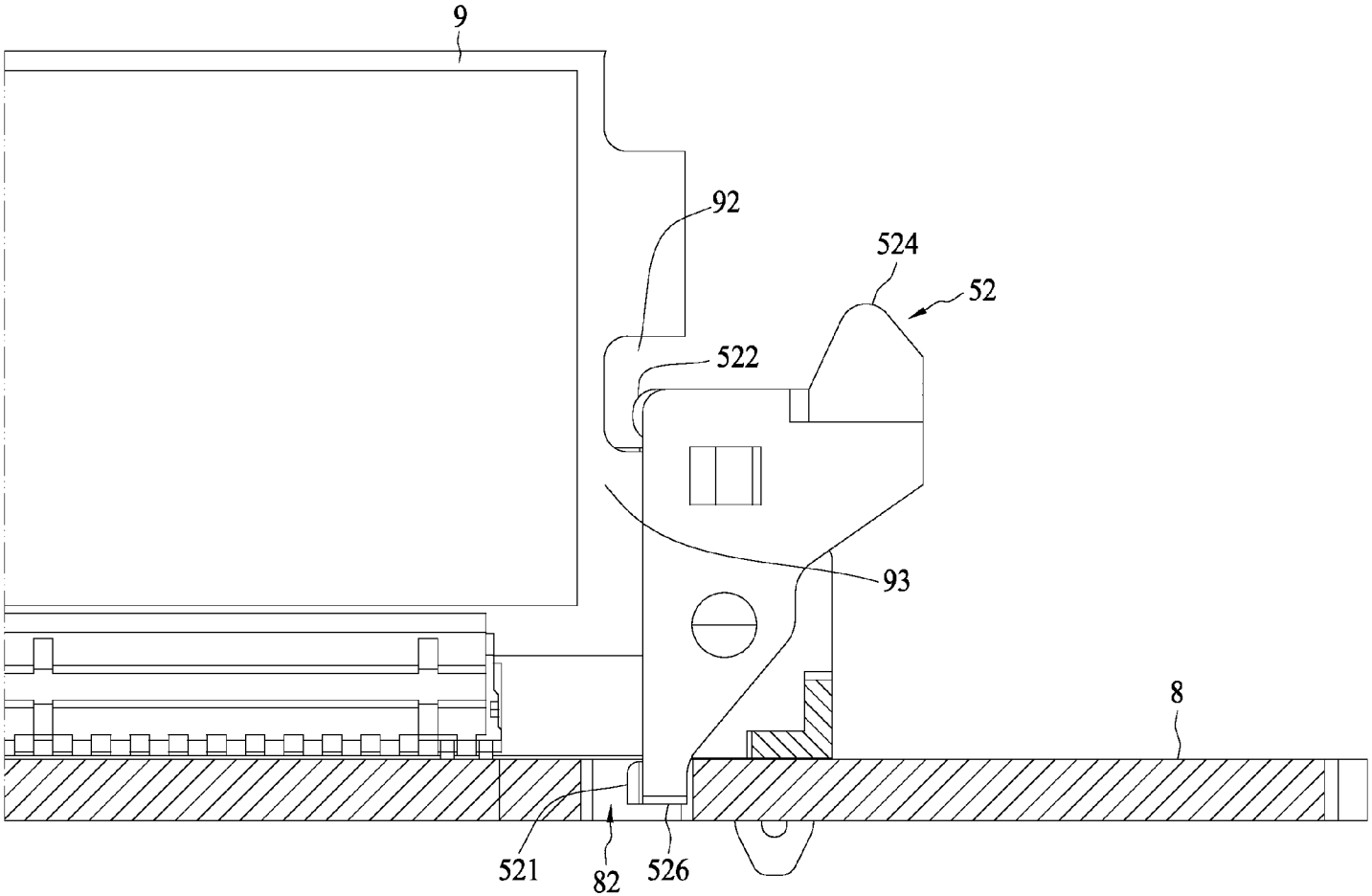
FIG. 13 is a front view of FIG. 12.

As shown in FIGS. 10 and 12, the ejecting portion 521 is configured to engage an edge 91 of a card module 9, thereby either pushing the edge 91 of the inserted card module 9 for ejection purpose or being pushed by the edge 91 of a card module 9 being inserted to rotate the latch/eject member 52.

When in a locking position as shown in FIG. 12, the latching portion 522 is configured to engage a respective one of the notches 92 disposed on opposite sides of the card module 9 for preventing the card module 9 from being accidentally removed from the card edge connector 5.

The latch/eject member 52 has a pair of pivot pins 523 protruding opposite to each other. The latch/eject member 52 can be rotated around the pair of pivot pins 523 when the push portion 524 is pressed or by the edge 91 of the card module 9 when the card module 9 is being inserted.

Figure 7:
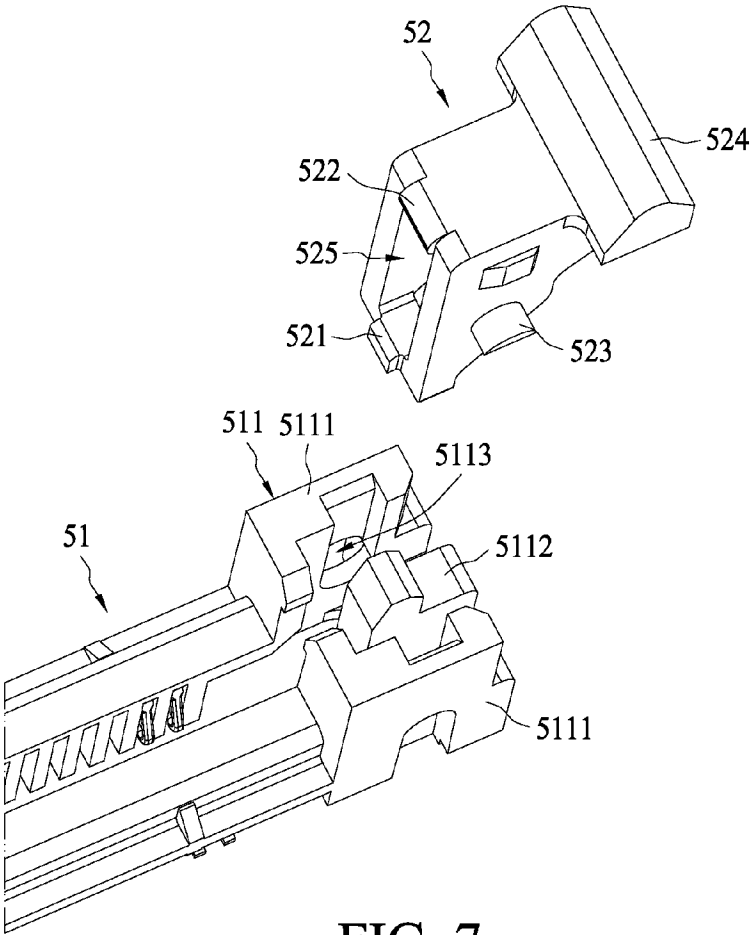
FIG. 7 is a perspective view showing an embodiment of a latch/eject member and an end portion of a dielectric housing.

Accordingly, the at least one of the two end portions 511 configured to receive the latch/eject member 52 includes two parallel side walls 5111 defining a space to allow the pivot movement of the latch/eject member 52 as shown in FIG. 7. A protrusion 5112 can be formed between the two side walls 5111 for confining the movement of an inserted card module 9 along the extension direction of the dielectric housing 51. Each side wall 5111 includes a pivot hole 5113 for receiving the respective pivot pin 523.

Referring to FIGS. 10 and 12, the latch/eject member 52 further includes a slit 525 extending between the ejecting portion 521 and the latching portion 522. The edge portion 93 of the card module 9 is partially located in the slit 525 when the latch/eject member 52 is in the locking position, and the protrusion 5112 is positioned in the slit 525. The slit 525 can be configured such that the edge portion 93 of the card module 9 and the protrusion 5112 do not interfere with the latch/eject member 52 during the rotation of the latch/eject member 52.

The card edge connector 5 may have one latch/eject member 52 to handle the insertion and ejection operations of a card module 9. However, as depicted the card edge connector 5 comprises a pair of latch/eject members 52 respectively received by the two end portions 511 of the dielectric housing 51.

Figure 6:
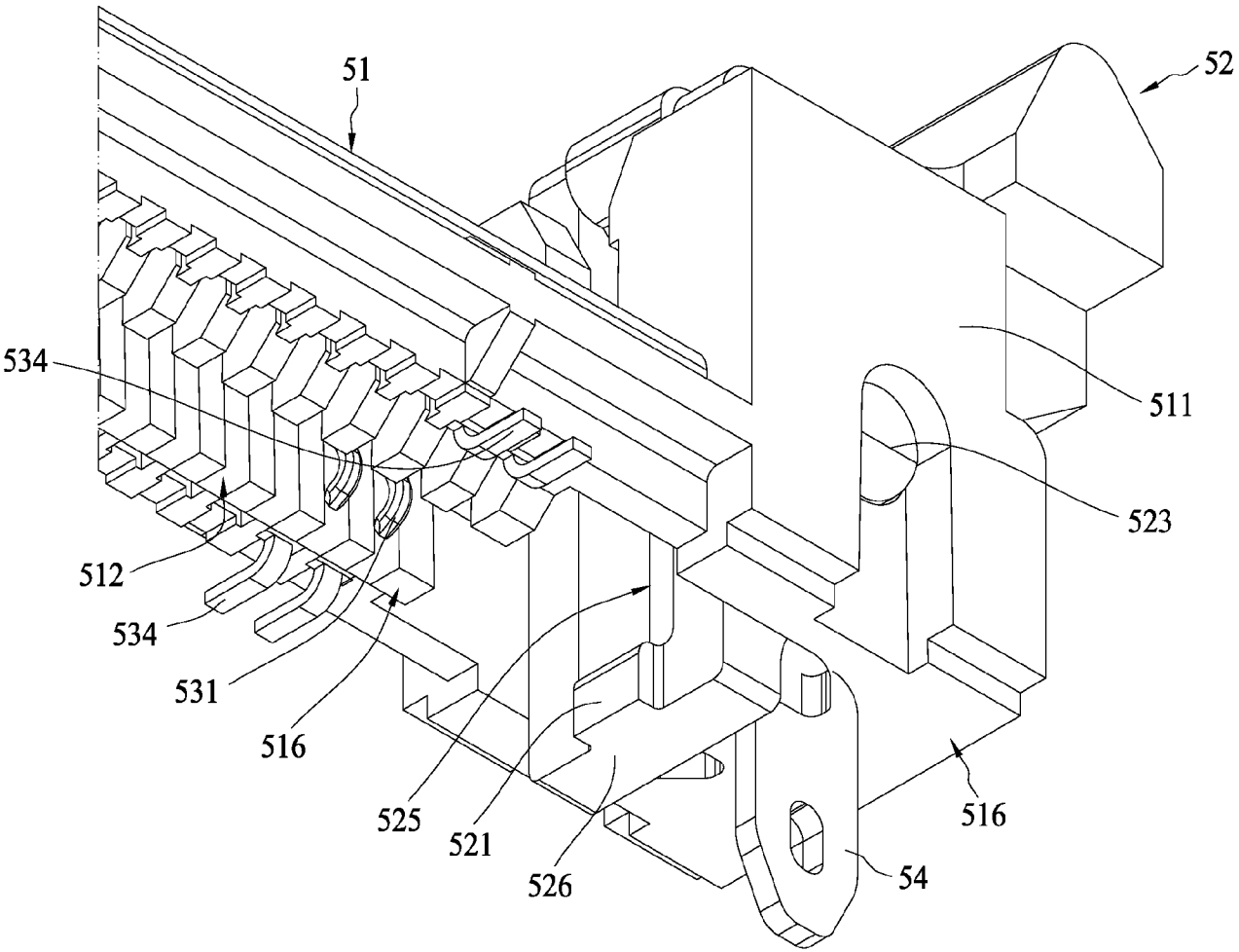
FIG. 6 is a perspective bottom view showing the relationship of the bottom of the dielectric housing and the lower end surface of the latch/eject member according to an exemplary embodiment.
Figure 8:
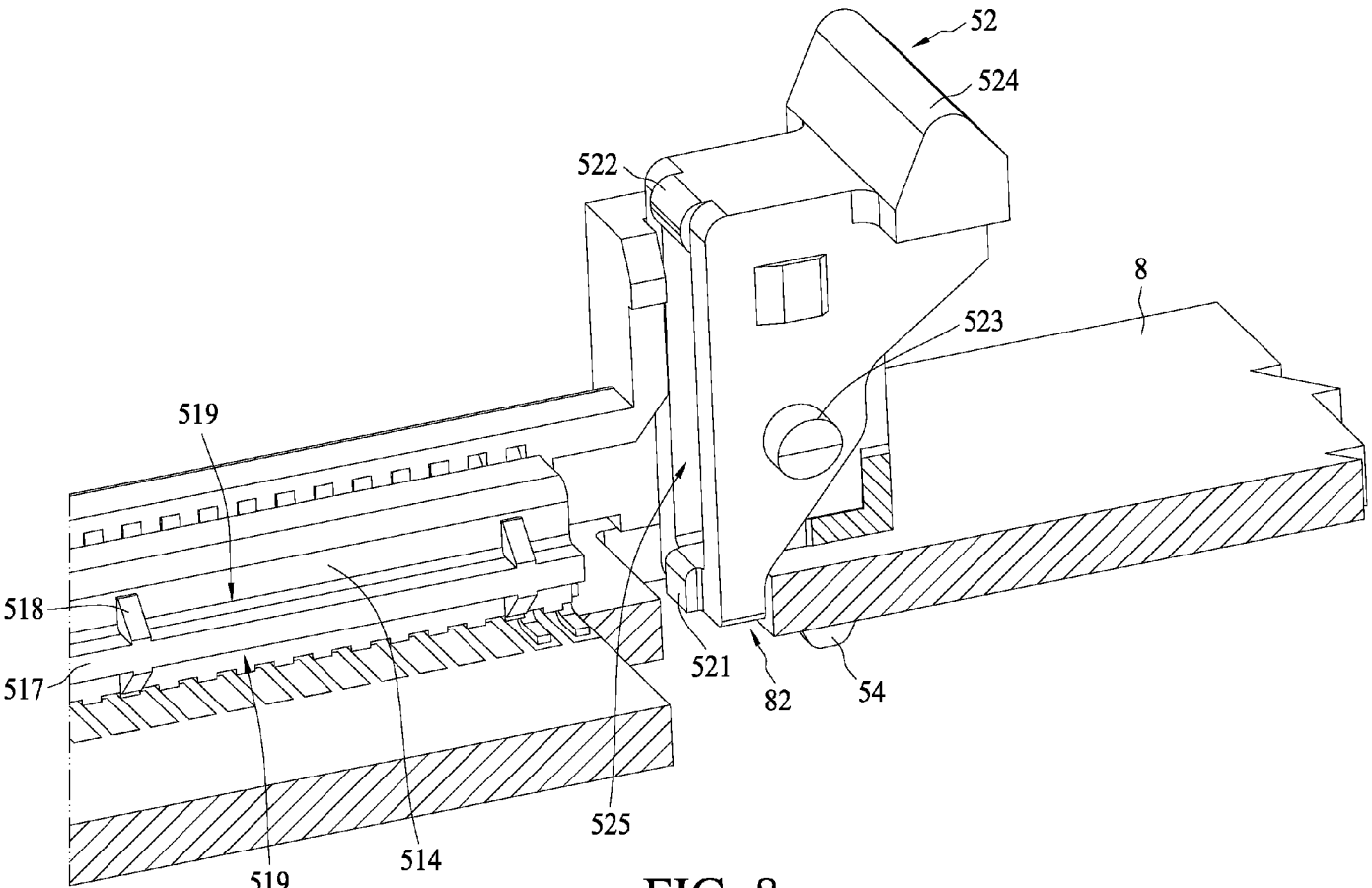
FIG. 8 is a fragmentary section view showing an embodiment of a latch/eject member in a locking position with its ejecting portion located in a hole in a circuit board.
Figure 9:
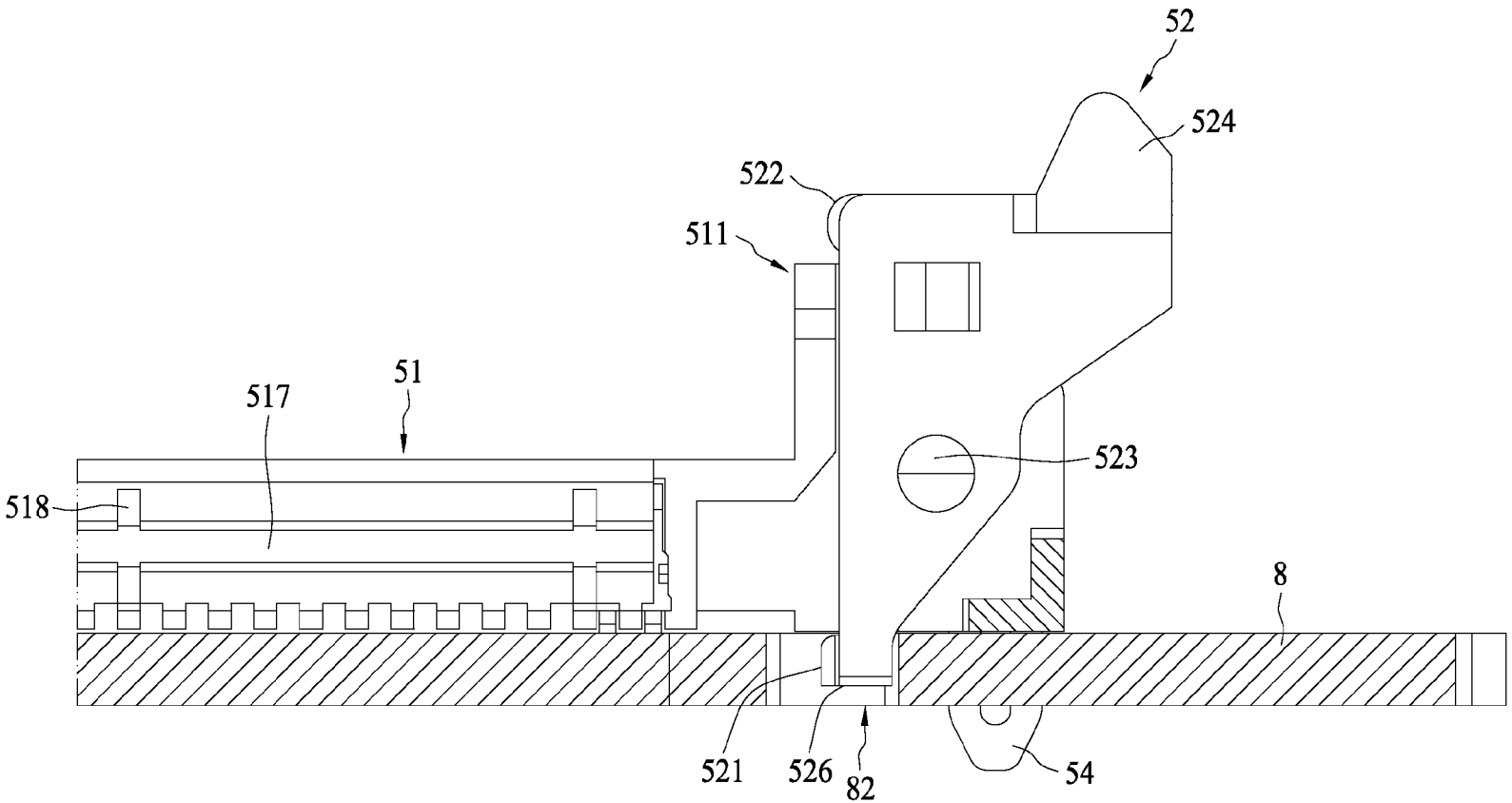
FIG. 9 is a front view of FIG. 8.
Figure 15:
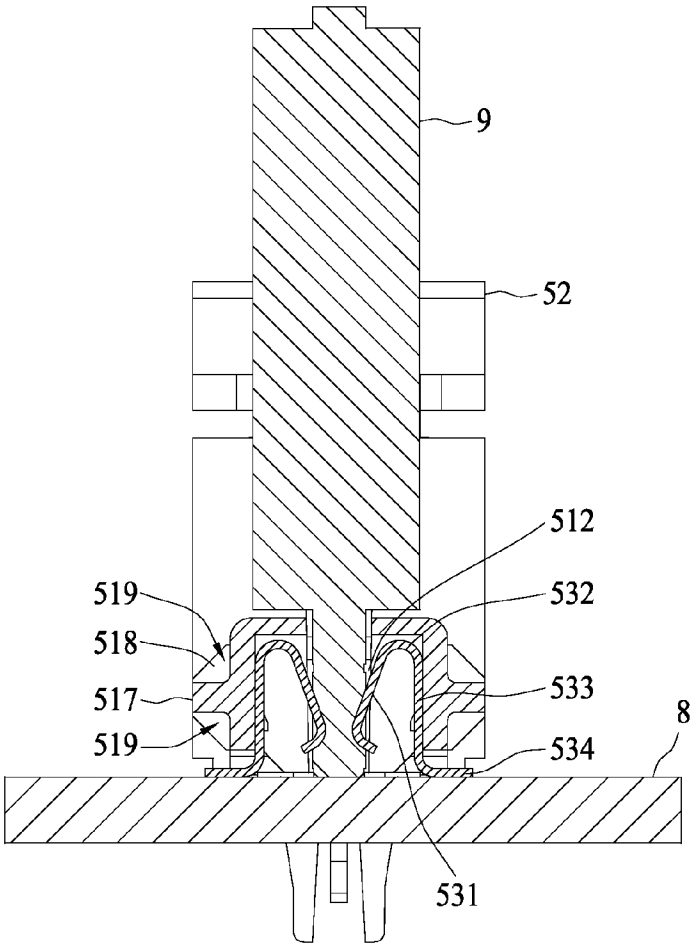
FIG. 15 is a cross-sectional view along line 15-15 of FIG. 14.
Figure 16:
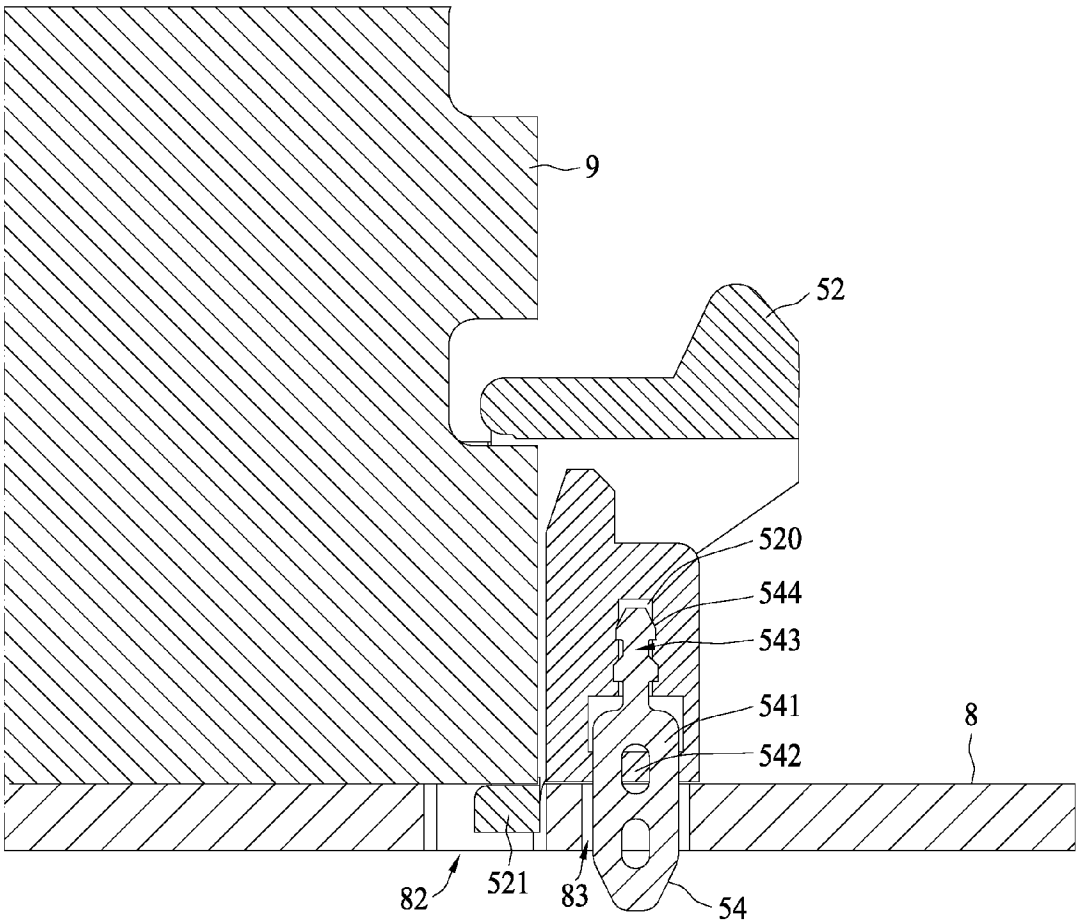
FIG. 16 is a cross-sectional view along line 16-16 of FIG. 14.

Referring to FIGS. 6, 8 and 9, the latch/eject member 52 may include a lower end surface 526. The card edge connector 5 allows an inserted card module 9 to have a height lower than that of a card module inserted into a conventional electrical connector. To this end, the distance between the edge 91 of an inserted card module 9 and the circuit board 8 is reduced by shortening the bottom portion of the dielectric housing 51. The bottom portion of the dielectric housing 51 can be shortened to allow the lower end surface 526 of the latch/eject member 52 to be located outside the dielectric housing 51 when the latch/eject member 52 is in a locking position as shown in FIG. 9. In one embodiment, the bottom portion of the dielectric housing 51 can be shortened such that the dielectric housing 51 may still have a thin seating base for supporting an inserted card module 9. In the present embodiment, the bottom portion of the dielectric housing 51 is shortened such that the card-receiving slot 512 becomes a through slot as shown in FIG. 6. As such, after the card module 9 is inserted, the card module 9 can directly rest on the circuit board 8 as shown in FIG. 15.

In addition, as shown in FIGS. 6 and 9, the bottom portion of the dielectric housing 51 is shortened such that the lower end surface 526 of the latch/eject member 52 is located outside the dielectric housing 51 when the latch/eject member 52 is in the locking position. In particular, the bottom portion of the dielectric housing 51 can be shortened as much as possible so long as the electrical and mechanical engagement between the card module 9 and the card edge connector 5 is proper and secured. In the present embodiment, the ejecting portion 521 of the latch/eject member 52 can be outside the dielectric housing 51 when the latch/eject member 52 is in the locking position as shown in FIG. 9.

Referring to FIG. 5 and FIGS. 10 to 13, the circuit board 8 comprises a hole 82 to accommodate the bottom section of the latch/eject member 52 protruding from the bottom of the dielectric housing 51, and the dimension of the hole 82 parallel to the extension direction of the dielectric housing 51 is configured to avoid interference between the ejecting portion 521 of the latch/eject member 52 and the hole 82 during the rotation of the latch/eject member 52.

In the present embodiment, the hole 82 is a through hole so as to contain the protruding ejecting portion 521; however, the hole 82 does not need to be a through hole if the bottom section of a latch/eject member 52 does not protrude too much.

Referring to FIGS. 8, 9, 14 and 15, if the height of the dielectric housing 51 is reduced so much that it has a thin or no seating base, the side walls 514 of the dielectric housing 51 may be weak and may suffer warpage during manufacturing. Thus, a projection member 517 can be disposed on the side wall 514 flanking the card-receiving slot 512 to reinforce the side wall 514 so as to prevent the side wall 514 from being warped. The projection member 517 may extend in a direction parallel to the extension direction of the card-receiving slot 512. Furthermore, a plurality of bracing ribs 518 can be disposed along the projection member 517 and in at least one corner 519 between the projection member 517 and the side wall 514. In the present embodiment, the bracing rib 518 has a triangular shape.

Figure 14:
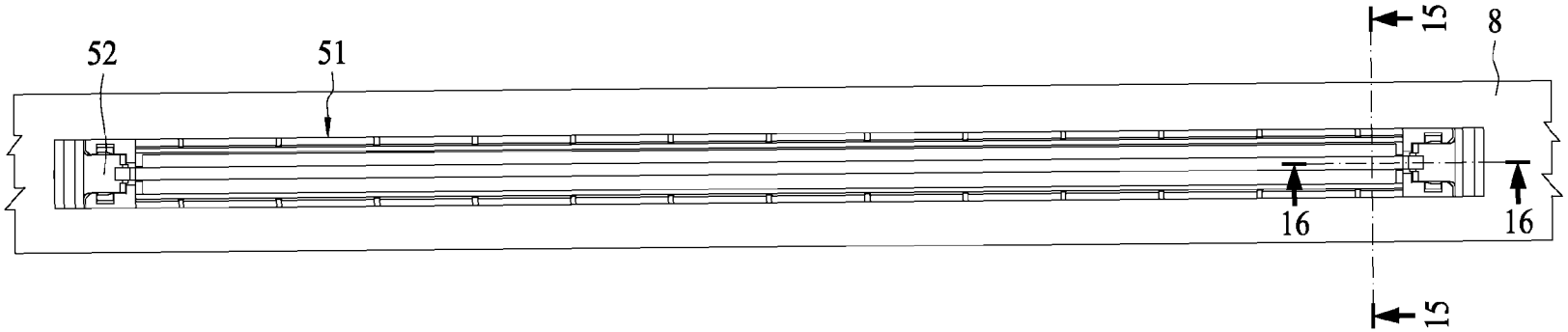
FIG. 14 is a top view showing an embodiment of a card edge connector mounted on a circuit board.

Referring to FIGS. 5, 14, and 15, the terminal 53 may comprise a contact portion 531, an inversely bent portion 532, a fixing portion 533, and a solder tail 534. The inversely bent portion 532 and the solder tail 534 are separately connected to opposite sides of the fixing portion 533, and the inversely bent portion 532 connects the contact portion 531 and the fixing portion 533. In the present embodiment, the inversely bent portion 532 is bent inversely at an angle less than 180 degrees such that the contact portion 531 can extend downward, next to and obliquely relative to the fixing portion 533 with its distal end located adjacent to the bottom of the dielectric housing 51.

In particular, the fixing portion 533 may have a plate-like shape, and may include a plurality of barbs 5331 and 5332 configured for interference fitting with the respective cavity 513 in the dielectric housing 51. Furthermore, the fixing portion 533, as shown in FIG. 5, can extend vertically across the respective cavity 513. The inversely bent portion 532 is inversely curved adjacent to the top of the cavity 513 so that the contact portion 531 can extend downward with a portion of the contact portion 531 protruding into the card-receiving slot 512, and finally, the distal end of the contact portion 531 can be bent into the respective cavity 513 as shown in FIG. 15. The inversely bent portion 532 can have, but is not limited to, a curved shape as shown in FIG. 5.

Referring back to FIGS. 5, 6, 9, and 16, the card edge connector 5 can further comprise a plurality of board locks 54 disposed on the bottom of the card edge connector 5, and the circuit board 8 may include a plurality of slits 83 disposed corresponding to the board locks 54. Each board lock 54 can be partially soldered in the respective slit 83 so as to secure the card edge connector 5 to the circuit board 8. Each board lock 54 may comprise a plate-like portion 541 and a stem portion 543 extending from the plate-like portion 541. The plate-like portion 541 may include a plurality of openings 542 for increasing soldering strength. The stem portion 543 may include a plurality of laterally protruding barbs 544 configured to interference fit with a cavity 520 formed in the dielectric housing 51. In particular, the plate-like portion 541 can be partially received in the slit 83 and partially received in the dielectric housing 51 so that the card edge connector 5 can be more securely held on the circuit board 8.

In summary, a card edge connector including a dielectric housing and a latch/eject member having a lower end surface located outside the dielectric housing when the latch/eject member is in a locking position is provided for reducing the height of an inserted card module. In one embodiment, the latch/eject member may include an ejecting portion mainly for ejecting an inserted card module, and the ejecting portion may be outside the dielectric housing when the latch/eject member is in a locking position. Further, the card-receiving slot formed on the dielectric housing may be above a thin seating base or may be a through slot. In addition, a projection member and a plurality of bracing ribs can be formed on the side wall flanking the card-receiving slot to reinforce the strength of the side wall.

The above-described embodiments are intended to be illustrative only. Numerous alternative embodiments may be devised by persons skilled in the art without departing from the scope the invention as defined by the following claims.

What is claimed is:

1. A card edge connector, comprising:

a dielectric housing including two end portions, a card-receiving slot extending between the two end portions for receiving a card module having oppositely disposed notches, and a plurality of cavities arrayed along the card-receiving slot;

a latch/eject member including an ejecting portion configured to engage an edge of the card module and a latching portion configured to engage one of the notches of the card module when the latch/eject member is in a locking position, and a lower end surface, wherein one of the end portions is configured to allow the latch/eject member to move therein in a pivoting manner, and the lower end surface of the latch/eject member is located outside the dielectric housing when the latch/eject member is in the locking position; and a plurality of terminals each received within a respective one of the plurality of cavities, each terminal including a fixing portion configured to secure the terminal in the respective cavity; a solder tail; and a contact portion at least partially extending into the card-receiving slot, wherein the solder tail and the contact portion are separately disposed on opposite sides of the fixing portion.

2. The card edge connector of claim 1, wherein the ejecting portion of the latch/eject member is located outside of the dielectric housing when the latch/eject member is in the locking position.

3. The card edge connector of claim 2, wherein the card-receiving slot is a through slot.

4. The card edge connector of claim 3, further comprising a projection member disposed on a side wall of the dielectric housing flanking the card-receiving slot, and a plurality of bracing ribs disposed along the projection member, wherein the projection extends parallel to the extension direction of the card-receiving slot.

5. The card edge connector of claim 3, wherein the terminal comprises an inversely bent portion, wherein the inversely bent portion connects the fixing portion and the contact portion such that the contact portion extends next to and obliquely relative to the fixing portion.

6. A connector assembly, comprising:

a card edge connector, the card edge connector including:

a dielectric housing including two end portions, a card-receiving slot extending between the two end portions and configured to receive a card module having oppositely disposed notches, and a plurality of cavities arrayed along the card-receiving slot;

a latch/eject member including an ejecting portion configured to engage an edge of the card module and a latching portion configured to engage one of the notches of the card module when the latch/eject member is in a locking position, and a lower end surface located outside a bottom of the dielectric housing, wherein one of the end portions is configured to allow the latch/eject member to move therein in a pivoting manner; and a plurality of terminals each received within a respective one of the plurality of cavities, each terminal including a fixing portion configured to secure the terminal in the respective cavity, a solder tail, and a contact portion at least partially extending into the card-receiving slot, wherein the solder tail and the contact portion are separately disposed on opposite sides of the fixing portion; and a circuit board including a hole disposed with respect to the latch/eject member, wherein the lower end surface of the latch/eject member is located in the hole when the latch/eject member is in the locking position.

7. The connector assembly of claim 6, wherein the ejecting portion of the latch/eject member is located in the hole when the latch/eject member is in the locking position.

8. The connector assembly of claim 7, wherein the card-receiving slot is a through slot.

9. The connector assembly of claim 8, wherein the hole is a through hole.

10. The connector assembly of claim 9, further comprising a projection member disposed on a side wall of the dielectric housing flanking the card-receiving slot and a plurality of bracing ribs disposed along the projection member, wherein the projection extends parallel to the extension direction of the card-receiving slot.

11. The connector assembly of claim 9, wherein the terminal comprises an inversely bent section, and the inversely bent section connects the fixing portion and the contact portion such that the contact portion extends next to and obliquely relative to the fixing portion.

* * * * *